US009121188B2

(12) United States Patent
von Bereghy

(10) Patent No.: US 9,121,188 B2
(45) Date of Patent: Sep. 1, 2015

(54) PERSONAL PROTECTIVE STRUCTURE

(75) Inventor: Robert Franklin von Bereghy, Rolling Bay, WA (US)

(73) Assignee: LifeGuard Structures LLC, Rolling Bay, WA (US)

( * ) Notice: Subject to any disclaimer, the term of this patent is extended or adjusted under 35 U.S.C. 154(b) by 324 days.

(21) Appl. No.: 13/106,597

(22) Filed: May 12, 2011

(65) Prior Publication Data

US 2012/0079968 A1 Apr. 5, 2012

Related U.S. Application Data

(60) Provisional application No. 61/390,126, filed on Oct. 5, 2010.

(51) Int. Cl.

| | |
|---|---|
| ***E04H 9/02*** | (2006.01) |
| ***A47B 3/06*** | (2006.01) |
| ***A47B 13/02*** | (2006.01) |
| ***A47B 47/03*** | (2006.01) |
| ***E04H 9/06*** | (2006.01) |

(52) U.S. Cl.

CPC *E04H 9/029* (2013.01); *A47B 3/06* (2013.01); *A47B 13/02* (2013.01); *A47B 47/03* (2013.01); *E04H 9/06* (2013.01); *Y10T 29/49826* (2015.01)

(58) Field of Classification Search

CPC ... E04H 2001/1283; E04H 1/005; E04H 1/04; E04H 9/02; E04H 1/1205; E04H 1/3483

USPC ..... 312/194, 195, 196, 265.1, 265.2, 265.3, 312/265.4, 223.3; 109/1 S; 52/167.1, 741.3

See application file for complete search history.

(56) References Cited

U.S. PATENT DOCUMENTS

| | | | | |
|---|---|---|---|---|
| 1,338,372 | A * | 4/1920 | Kammerich | 109/11 |
| 1,463,289 | A * | 7/1923 | Mitchell | 312/29 |
| 1,507,427 | A * | 9/1924 | Rossiter | 312/194 |

(Continued)

FOREIGN PATENT DOCUMENTS

| | | |
|---|---|---|
| FR | 2731033 | 8/1996 |
| GR | 1003867 | 4/2002 |

(Continued)

OTHER PUBLICATIONS

Haishan Deng, "Life Desk," Yanko Design, Dec. 31, 2008, 3 pages. http://www.yankodesign.com/2008/12/31/triangle-of-life/.

*Primary Examiner* — Joshua J Michener
*Assistant Examiner* — Matthew Gitlin
(74) *Attorney, Agent, or Firm* — Seed IP Law Group PLLC

(57) ABSTRACT

A protective structure for personal and or group protection designed to withstand falling objects, flying objects and structural failure resulting from earthquakes or other dangers known and unknown is provided. The protective structure includes a support structure having an internal cavity sized to accommodate one or more persons. The support structure has a skeletal frame of elongated structural members and a structural skin coupled to at least a majority of a perimeter of the skeletal frame. An overlay may cover at least a portion of an exterior surface of the support structure such that the support structure is at least partially concealed and resembles school, office or home furniture. The protective structure is designed to protect the occupant from an initial disaster, such as an earthquake, and maintain protection until rescue is made or risks of injury diminish.

40 Claims, 7 Drawing Sheets

(56) References Cited

U.S. PATENT DOCUMENTS

| | | | | | |
|---|---|---|---|---|---|
| 1,508,259 | A | * | 9/1924 | Stafford | 312/195 |
| 1,918,780 | A | * | 7/1933 | Rand | 312/195 |
| D162,927 | S | * | 4/1951 | Bloom | D6/428 |
| 2,730,421 | A | * | 1/1956 | Burst et al. | 312/265.4 |
| 3,125,387 | A | * | 3/1964 | Abrahamson | 312/195 |
| 3,241,900 | A | * | 3/1966 | Hamilton et al. | 312/194 |
| 3,346,311 | A | * | 10/1967 | Bears | 312/195 |
| 3,498,654 | A | * | 3/1970 | Diaz et al. | 52/653.2 |
| 3,600,050 | A | * | 8/1971 | Kunishima | 312/194 |
| 3,647,274 | A | * | 3/1972 | Schnelle | 312/265.4 |
| 4,045,104 | A | * | 8/1977 | Peterson | 312/265.4 |
| 4,187,649 | A | * | 2/1980 | Chaffee | 312/140 |
| 4,443,992 | A | * | 4/1984 | Shechter | 52/745.02 |
| 4,490,864 | A | | 1/1985 | Wicker, Jr. | |
| 4,973,110 | A | * | 11/1990 | Nyquist | 312/265.3 |
| 5,241,717 | A | | 9/1993 | Ward et al. | |
| 5,354,126 | A | | 10/1994 | Pedrego | |
| 5,546,873 | A | * | 8/1996 | Conner et al. | 108/90 |
| 5,737,784 | A | * | 4/1998 | Jackman | 5/414 |
| 5,813,174 | A | * | 9/1998 | Waller | 52/79.1 |
| 5,848,500 | A | * | 12/1998 | Kirk | 52/79.1 |
| 6,293,637 | B1 | * | 9/2001 | Anderson et al. | 312/265.1 |
| 6,308,466 | B1 | | 10/2001 | Moriarty | 52/79.5 |
| 6,539,674 | B2 | * | 4/2003 | Arnold | 52/79.1 |
| 7,827,738 | B2 | * | 11/2010 | Abrams et al. | 52/79.1 |
| 2001/0039770 | A1 | | 11/2001 | Arnold | 52/169.6 |
| 2002/0121387 | A1 | * | 9/2002 | Suzuki et al. | 174/50 |
| 2003/0200706 | A1 | * | 10/2003 | Kahan et al. | 52/167.3 |
| 2004/0020873 | A1 | * | 2/2004 | Henderson | 211/26 |
| 2007/0257585 | A1 | * | 11/2007 | Kenny et al. | 312/265.4 |
| 2008/0134589 | A1 | * | 6/2008 | Abrams et al. | 52/79.1 |
| 2009/0236957 | A1 | * | 9/2009 | Hudz et al. | 312/265.4 |
| 2012/0151851 | A1 | * | 6/2012 | Cantin et al. | 52/79.5 |
| 2013/0000225 | A1 | * | 1/2013 | D'Ancona | 52/167.1 |
| 2013/0092059 | A1 | * | 4/2013 | Brutter et al. | 108/11 |

FOREIGN PATENT DOCUMENTS

| | | |
|---|---|---|
| GR | 1003867 B2 | 4/2002 |
| JP | 11099217 | 4/1996 |
| WO | 2008/066400 | 6/2008 |

* cited by examiner

PERSONAL PROTECTIVE STRUCTURE

CROSS-REFERENCE TO RELATED APPLICATION

This application claims the benefit under 35 U.S.C. §119 (e) of U.S. Provisional Patent Application No. 61/390,126 filed Oct. 5, 2010, where this provisional application is incorporated herein by reference in its entirety.

BACKGROUND

1. Technical Field

This disclosure generally relates to personal protective structures, including, for example, personal protective structures in the form of furniture such as desks, tables and the like, and methods of making the same.

2. Description of the Related Art

Furniture such as desks, tables and the like are well known structures used in office settings, homes and other locations. During times of emergencies, such as during an earthquake, it is generally known that one option for protection is to seek shelter under such structures. Conventional furniture, however, is built to withstand only moderate loads consistent with everyday use and thus is often insufficient to adequately protect those seeking refuge.

BRIEF SUMMARY

According to one embodiment, a personal protective structure is provided for providing protection from falling or collapsing objects or structures. An illustrative system includes a support structure including a skeletal frame of elongated structural members and a skin of sheet or plate sidewalls. The support structure can be covered with overlays, such as, for example, hardwood plywood overlays on its exterior surfaces such that the personal protection structure resembles and can be used as an ordinary piece of furniture, but is built with the structural integrity to withstand substantial impact and static loads. The personal protective structure may resemble a desk, for example, which includes an opening such that the user can enter a cavity of the desk when an emergency situation occurs and there are no other reasonable methods of escape or protection. Inside the desk, the occupant may be further protected by padding and other comforts located therein. The occupant may also be furnished with a number of safety products. These safety products may include a number of emergency items including, for example, a fire extinguisher, lighting, signaling devices, respirators, a medical kit, emergency rations, supplemental air and provisions for sanitary waste.

At least one embodiment of a personal protective structure to provide protection during earthquakes and other events may be summarized as including a support structure having an internal cavity sized to accommodate one or more persons, the support structure including a skeletal frame of elongated structural members and a structural skin coupled to at least a majority of a perimeter of the skeletal frame. The personal protective structure may include an overlay covering at least a portion of an exterior surface of the support structure such that the support structure is at least partially concealed.

The skeletal frame of personal protective structure may include an upper frame assembly designed to absorb kinetic energy through permanent deformation thereof when a substantial impact load is applied to the upper surface of the personal protective structure. The upper frame assembly of the skeletal frame may include horizontal elongated structural members disposed above and supported at least in part by elongated vertical support members of the skeletal frame. The horizontal elongated structural members may be sized and configured to permanently deform prior to any substantial permanent deformation of the elongated vertical support members when a substantial impact load is applied to an upper surface of the personal protective structure.

The support structure may further include a lower horizontal sheet and an upper horizontal sheet coupled to the skeletal frame. The lower horizontal sheet and the upper horizontal sheet may be steel sheet or steel plate material. The upper horizontal sheet may be a steel plate having a thickness of at least one-eighth inch to protect against penetration from falling objects from an overhead direction. The structural skin may be formed of sidewall members of steel sheet or steel plate material having a thickness of at least one-sixteenth inch. The support structure may further include cross braces coupled to the structural skin and skeletal frame.

An overlay may cover an upper surface of the support structure and define a working surface of the personal protective structure. Other overlays may be included to partially conceal, substantially conceal or entirely conceal the support structure. The overlays may comprise wood, metal, glass, ceramics, composites, plastics or combinations thereof and may be secured to the support structure via fasteners, adhesives or other devices.

An internal cavity of the support structure may have a volume equal to or greater than ten cubic feet, and preferably equal to or greater than twenty cubic feet. An area of a footprint of the personal protective structure may be less than twenty-five square feet and a height of the personal protective structure may be 42 inches or less.

The personal protective structure may configured to support a static load of at least 50,000 lbs distributed over an upper surface of the personal protective structure without substantial permanent deformation of the elongated vertical support members. In other embodiments, the personal protective structure may configured to support a static load of at least 100,000 lbs., 250,000 lbs., 500,000 lbs., 750,000 lbs. or 1,000,000 distributed over an upper surface of the personal protective structure without substantial permanent deformation of the elongated vertical support members. A strength-to-weight ratio of the personal protective structure in terms of supportable static load without substantial permanent deformation of the elongated vertical support members may be at least 1000 lbs. of static load for each pound of weight of the personal protective structure. The personal protective structure may be configured to withstand a drop load of at least 10,000 lbs., and preferably at least 50,000 lbs., that impacts an upper surface of the personal protective structure in a generally evenly distributed manner from a height of about ten feet without substantial permanent deformation of the elongated vertical support members.

Some embodiments of the personal protective structures described herein provide ultra high strength protective enclosures to survive the worst case typical masonry building failure up to eight stories and many other scenarios in larger buildings. It is also evident that these structures will also protect against warehouse dangers, and other risks known and unknown.

DETAILED DESCRIPTION

Figure 1:
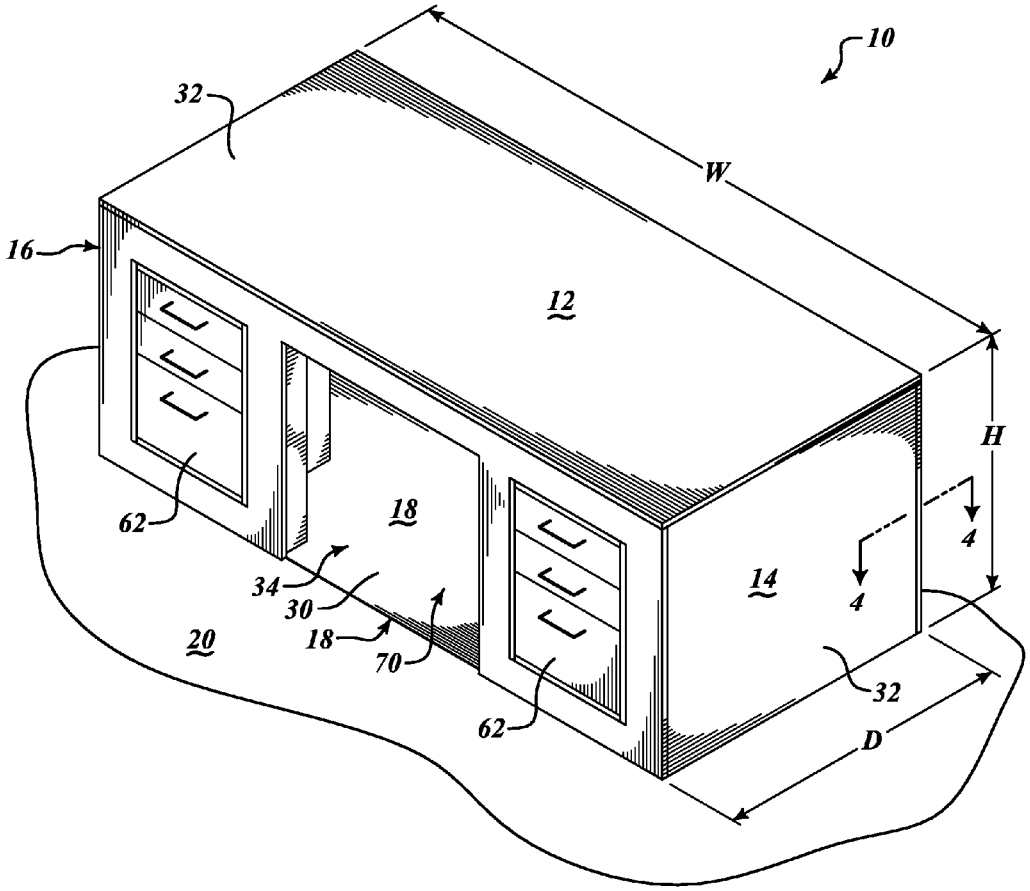
FIG. 1 is a front isometric view of a personal protective structure, according to one embodiment, in the form of a desk.
Figure 2:
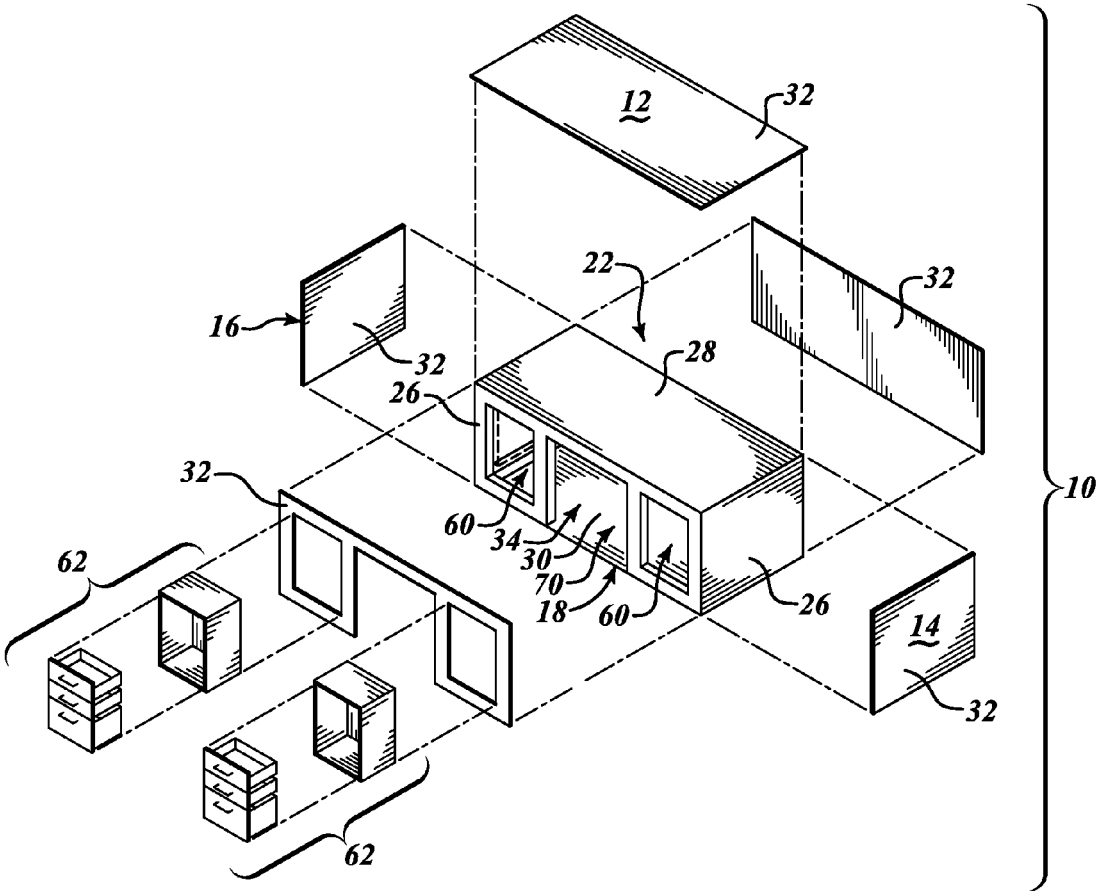
FIG. 2 is a partially exploded front isometric view of the personal protective structure of FIG. 1, showing an inner support structure thereof in an assembled configuration.

In the following description, certain specific details are set forth in order to provide a thorough understanding of various disclosed embodiments. However, one skilled in the relevant art will recognize that embodiments may be practiced without one or more of these specific details. In other instances, well-known structures and manufacturing techniques associated with furniture and structural weldments may not be shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

FIGS. 1 through 4 illustrate a personal protective structure in the form of a desk 10 according to one embodiment. The desk 10 includes a top working surface 12, opposing side surfaces 14, 16, and bottom surface 18 for resting on a floor or ground surface 20. The desk 10 has a support structure 22 (FIG. 2) which includes a skeletal frame or framework 24 of elongated structural members and a skin of sidewall members 26 coupled thereto. The support structure 22 further includes an upper horizontal sheet or plate 28 and a lower horizontal sheet or plate 30 overlying and underlying the skeletal frame 24, respectively. The components of the support structure 22 (e.g., the skeletal frame 24 and the sidewall members 26) are preferably made of mild or high strength steel and are welded together to form a particularly rigid structure which has a high strength-to-weight ratio. The size, location and type of welds are typically dependent on the size and orientation of materials to be joined and will be apparent to those of skill in the art knowledgeable of conventional welding techniques. Accordingly, weld characteristics are not shown or described in detail to avoid unnecessarily obscuring descriptions of the embodiments. In other embodiments, components of the support structure 22 may be fastened or joined together in other ways, such as, for example, by using bolts, rivets or other fasteners.

The support structure 22 (FIG. 2) of the desk 10 illustrated in FIGS. 1 through 4 is substantially encased on outer surfaces thereof by a plurality of overlays 32, such as, for example, hardwood plywoods. The overlays 32 may be made of wood, metal, glass, ceramics, composites, plastics or combinations thereof. Although the support structure 22 of the illustrated desk 10 is shown as being substantially encased by a plurality of overlays 32, in some embodiments the exterior surfaces of the support structure 22 may be partially exposed, or in other embodiments, completely exposed when no overlays 32 are provided. In some embodiments, the overlays 32 cover at least a majority (i.e., more than 50 percent) of an exterior surface of the support structure 22. The overlays 32 may be secured to the support structure 22 via fasteners, adhesives or other devices.

As shown best in FIG. 1, an opening 34 is provided at the front of the desk 10 for providing clearance for a user when sitting at the desk, and also for providing an entrance to the desk 10 for entering the protective structure in times of emergency. The opening 34 provides access to an interior space wherein one or more persons may seek refuge.

Figure 3:
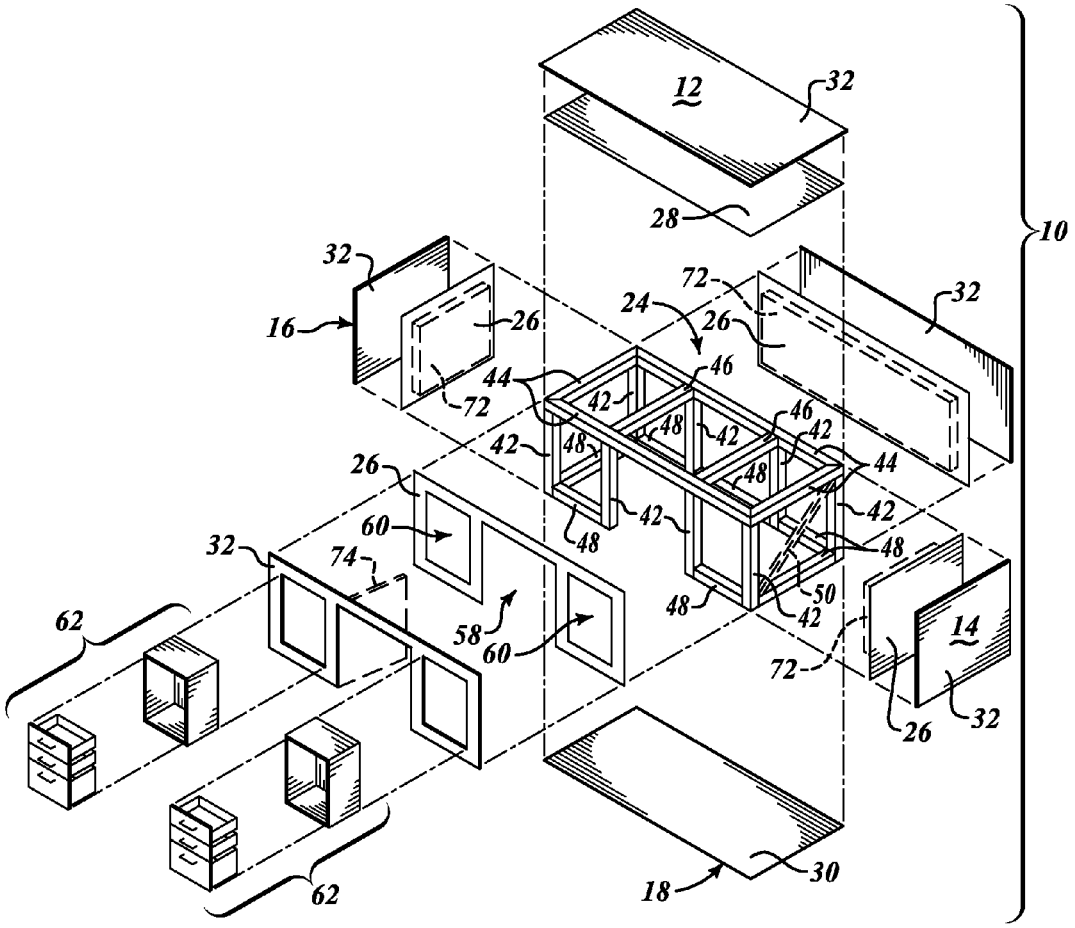
FIG. 3 is a front isometric exploded view of the personal protective structure of FIG. 1.
Figure 4:
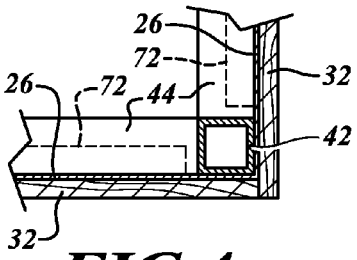
FIG. 4 is a partial cross-sectional view of the personal protective structure of FIG. 1 taken along line 4-4.

With reference to FIG. 3, the skeletal frame or framework 24 includes an upper framework 40 of elongated structural members supported by vertical support members 42. More particularly, the upper framework 40 includes a rectangular perimeter of horizontally aligned structural members 44 supported on the vertical support members 42. The ends of the perimeter of structural members 44 of the upper framework 40 may be mitered and joined as shown. Transverse structural members 46 span between longitudinal ones of the structural members 44 of the perimeter of the upper framework 40. At a lower end of the skeletal frame 30, horizontally aligned structural members 48 span between selected pairs of adjacent vertical support members 42. In the illustrated embodiment of FIGS. 1 through 4, each vertical support member 42 is directly coupled to at least two other structural members of the skeletal frame 24. In this manner, the skeletal frame 24 is defined by a network of elongated structural members 42, 44, 46, 48 to form a structural web having an overall box-like shape. The elongated structural members 42, 44, 46, 48 may be tubular members, such as, for example, square or round tube stock, or non-tubular members, such as, for example, bars, channels, angles or I-beams. Further, although the elongated structural members 42, 44, 46, 48 are illustrated as having a similar size and shape, the structural members 42, 44, 46, 48 may be of different size or shapes. For example, in some embodiments, the vertical support members 42 may be box tubes of one thickness and the horizontally aligned structural members 44 of the upper framework 40 may be box tubes of a different thickness. As another example, in some embodiments, the elongated structural members 42, 44, 46, 48 may be cylindrical tubes of different diameters. In addition, the elongated structural members 42, 44, 46, 48 may be the same material or different materials. For example, the vertical support members 42 and horizontally aligned structural members 44 of the upper framework 40 may be steel of different grades having different strengths.

As previously described, in the illustrated embodiment of FIGS. 1 through 4, the support structure 22 further includes an upper horizontal sheet or plate 28 and a lower horizontal sheet or plate 30 overlying and underlying the skeletal frame 24, respectively. Although the upper and lower sheets or plates 28, are illustrated as generally uniform sheets or plates, it is contemplated that the upper and lower sheets or plates 28, 30 may comprise perforated sheet, mesh sheet or other sheet materials having openings or cutouts therein. In some embodiments, the upper and lower sheets or plates 28, 30 are welded or otherwise fastened to the skeletal frame 24. In other embodiments, the support structure 22 may be constructed without an upper horizontal sheet or plate 28 and/or without a lower horizontal sheet or plate 30.

As previously described, the structural framework 24 of the illustrated embodiment of FIGS. 1 through 4 is also coupled to sidewall members 26 to form the support structure 22 which is characterized by a network of elongated structural members at least partially wrapped in a structural skin. The sidewall member 26 located in the front of the desk 10 includes a cut-out portion 58 for providing clearance for a user when sitting at the desk, and also for providing an opening or entrance 34 to the desk 10 for entering the protective structure in times of emergency. Other openings 60 may be formed in the front sidewall to receive optional drawer 62 or storage structures. Although the sidewall members 26 are illustrated as generally uniform sheets or plates, it is contemplated that the sidewall members 26 may comprise perforated sheet, mesh sheet or other sheet materials having openings or cutouts therein.

The completed support structure 22 includes a network of structural members 42, 44, 46, 48 (which define the internal skeletal frame 24) wrapped in sheet or plate material to form a protective enclosure defining a cavity 70 within the interior of the desk 10 to accommodate one or more persons during emergency situations. The cavity 70 of the desk 10 preferably has a volume of at least ten cubic feet to accommodate at least one person in a reasonably comfortable position. This is particularly advantageous in the event that circumstances require that one occupy the personal protective structure for an extended period of time. In some embodiments, the volume of the cavity 70 is at least twenty cubic feet. In other embodiments, the volume of the cavity 70 may be less than ten cubic feet.

The interior cavity 70 of the desk 10 may be lined with optional protective padding 72, such as aluminized thermal padding, to reduce the risk of injury or harm to the occupant in an emergency. The padding 72 may provide protection between the occupant(s) and the support structure 22 and act as short term protection against heat should a fire ensue. The padding 72 also enhances comfort of the occupant(s) especially if the protective desk 10 is occupied for an extended period of time. The entrance/exit 34 may also be fitted with a door 74, such as a locking "slam door," for enhanced protection from flying debris and subsequent air contamination. The door 72 may be formed of a lighter gauge material than the sidewall members 26 of the support structure 22.

In some embodiments, the desk 10 may also be furnished with a number of life safety products. These products may include a number of emergency items including, for example, a fire extinguisher, lighting, signaling devices, respirator, medical kit, emergency rations, supplemental air and items for sanitary waste.

The structural members 42, 44, 46, 48 of the skeletal frame 24 are preferably formed of structural tubes having a closed cross-sectional profile, although other structural members, such as, for example, I-beams, bars, channels and angles are contemplated. Furthermore, it is contemplated that more or fewer structural members 42, 44, 46, 48 than those illustrated may be provided and that vertical support members 42 may also be provided inwardly from the perimeter of the framework 24. The structural members 42, 44, 46, 48 of the skeletal frame 24 are arranged such that if the desk 10 should roll or turn over during an emergency situation or other event, at least some of the structural members 42, 44, 46, 48 would act as vertical support members and protect the structure from collapsing or buckling when subjected to significant overhead loads.

In one embodiment, the desk 10 is constructed with an internal skeletal frame 24 made of a network of mild or high strength steel tubes wrapped with steel plate sidewall members 26 on all sides to form a box-like enclosure. The desk 10 further includes an upper steel sheet or plate 28 and a lower steel sheet or plate 30 overlying and underlying the skeletal frame 24. The desk 10 is then finished with a decorative or functional "skin" such as overlays 32 of wood or other materials. The skeletal frame 24 may be constructed solely of horizontal and vertical elongated structural members 42, 44, 46, 48, or, in some embodiments, may include additional cross-braces 50. When present, the cross-braces 50 can be coupled to intermediate portions of the sidewall members 26 to aid in securing the intermediate portions of the sidewall members 26 to the skeletal frame 24 to prevent bowing of the same and enhance lateral load countering effects of the protective structure under extreme loading conditions.

In one embodiment, the structural members 42, 44, 46, 48 are mild or high strength tube stock, such as, for example, 3"×3"×⅛" A500 steel tubes, the sidewall members 26 are steel plates having a nominal thickness of at least 1/16" and strength equal to or greater than A1011 steel, and the upper and the bottom plates are at least ⅛" A36 steel plates or similar material. The components of the skeletal frame 22 may be welded together to form a rigid integral skeletal structure, or may otherwise be fastened or coupled together with fasteners or other devices. In this manner, the desk 10 is able to maintain its integrity even in the event that it is rolled or flipped. In some embodiments, the top and/or bottom plates 28, 30 are at least ¼" thick to provide enhanced protection against stab type penetrations that might otherwise be experienced if thinner plates or sheets were utilized.

According to at least one embodiment, the upper framework or frame assembly 40 may be designed as a crumple zone to absorb a portion of kinetic energy from the initial impact or impacts of falling objects during an emergency situation. For example, in some embodiments, an upper frame assembly 40 is designed to absorb kinetic energy through permanent deformation thereof when a substantial impact load is applied to the upper surface 12 of the personal protective structure. The folding or compression of the crumple zone does not significantly affect the vertical supports 42 or the lateral load countering effects of the sidewall members 26.

In one embodiment, the crumple zone includes a plurality of horizontally aligned elongated structural members 44, 46, such as, for example, box tube structures welded or otherwise coupled together in a network and supported by vertical support members 42. The elongated structural members 44, 46 may be of different gauge are sizes depending on the load rating of the personal protective structure. For example, in some embodiments, the elongated structural members 44, 46 are 3"×3"×⅛" A500 steel box tubes. In other embodiments, the elongated structural members 44, 46 of the upper framework 40 are 1"×3"×1/16" A500 steel box tubes. The elongated structural members 44, 46 are preferably sized and configured to permanently deform prior to any substantial permanent deformation of the elongated vertical support members 42 when a substantial impact load is applied to an upper surface 12 of the personal protective structure. In this context, substantial permanent deformation means greater than a one percent change in overall height of the vertical support members 42. Substantial permanent deformation does not include minor dents, gouges and the like.

In some embodiments, specific welding patterns may be utilized to enhance the performance of the crumple zone and its relationship to the vertical skin structure defined by the sidewall members 26. For example, welds may be sequenced to promote uniform heat distribution during the welding process to prevent distortions which may result from localized overheating, which in turn can negatively impact the performance of the crumple zone, skin structure and ultimately the personal protective structure.

In some embodiments, the support structure 22 is designed to withstand a drop load of at least 10,000 lbs., and preferably at least 50,000 lbs., that impacts an upper surface 12 of the personal protective structure in a generally evenly distributed manner from a height of about ten feet without substantial permanent deformation of the elongated vertical support members 42. Again, in this context, substantial permanent deformation means greater than a one percent change in overall height of the vertical support members 42. Substantial permanent deformation does not include minor dents, gouges and the like.

In other embodiments, the support structure 22 of the desk 10 may be designed to withstand static loads distributed over an upper surface 12 thereof in excess of 50,000 lbs., 100,000 lbs., 150,000 lbs., 200,000 lbs., 250,000 lbs. or 300,000 lbs. without substantial permanent deformation of the vertical support members 42. In other relatively higher strength embodiments, the support structure 22 of the desk 10 may be designed to withstand static loads distributed over an upper surface 12 thereof in excess of 500,000 lbs., 750,000 lbs., or 1,000,000 lbs. without substantial permanent deformation of the vertical support members 42.

In embodiments that are rated to support a static load in excess of 1,000,000 lbs., the total weight of the protective structure is preferably less than 1000 lbs. In embodiments that are rated to support a static load in excess of 750,000 lbs., the total weight of the protective structure is preferably less than 750 lbs. In embodiments that are rated to support a static load in excess of 500,000 lbs., the total weight of the protective structure is preferably less than 500 lbs. In embodiments that are rated to support a static load in excess of 250,000 lbs., the total weight of the protective structure is preferably less than 250 lbs. Accordingly, in such embodiments, a strength-to-weight ratio of the personal protective structure in terms of supportable static load without substantial permanent deformation of the elongated vertical support members 42 is at least 1000 lbs. of static load per pound of weight of the personal protective structure.

According to some embodiments, the footprint of the personal protective structure (i.e., the floor area covered by the structure) is less than twenty-five square feet, and in other embodiments, is less than twenty square feet. In still other embodiments, the footprint is less than ten square feet. Consequently, the personal protection structures can provide enhanced protection for one or more persons in a relatively small form factor.

A height H of the desk 10 of the illustrated embodiment of FIGS. 1 through 4 is preferably 42 inches or less. In some embodiments, a width W of the desk 10 is between 56 inches and 80 inches, and preferably between 60 inches and 76 inches. In some embodiments, a depth D of the desk 10 is between 24 inches and 44 inches, and preferably between 30 inches and 38 inches.

In one embodiment, a desk 10 has a height H of about 30 inches, a width W of about 78 inches, and a depth of about 34 inches. The skeletal frame 24 is formed of 3"×3"×⅛" steel box tubes, then wrapped with sidewall members 26 of ⅛" thick steel sheet and topped with an upper sheet of ¼" steel plate to form the internal support structure 22. The desk 10 formed in this manner can be configured to support a static load distributed over an upper surface 12 thereof in excess of 1,000,000 lbs.

In another embodiment, a desk 10 has a height H of about 30 inches, a width W of about 66 inches, and a depth of about 34 inches. The skeletal frame 24 is formed of 3"×3"×⅛" steel box tubes, then wrapped with sidewall members 26 of ⅛" thick steel sheet and topped with an upper sheet of ⅛" steel plate to form the support structure 22. The desk 10 formed in this manner can also be configured to support a static load distributed over an upper surface 12 thereof in excess of 1,000,000 lbs.

Personal protective structures of varying strength may be tailored to specific applications, such as, for example, placement in buildings of particular heights or in areas having particularly hazardous materials. In addition, size may be selected to reflect the intended use of the structure. For example, smaller models may be provided as desks for school children.

Figure 5:
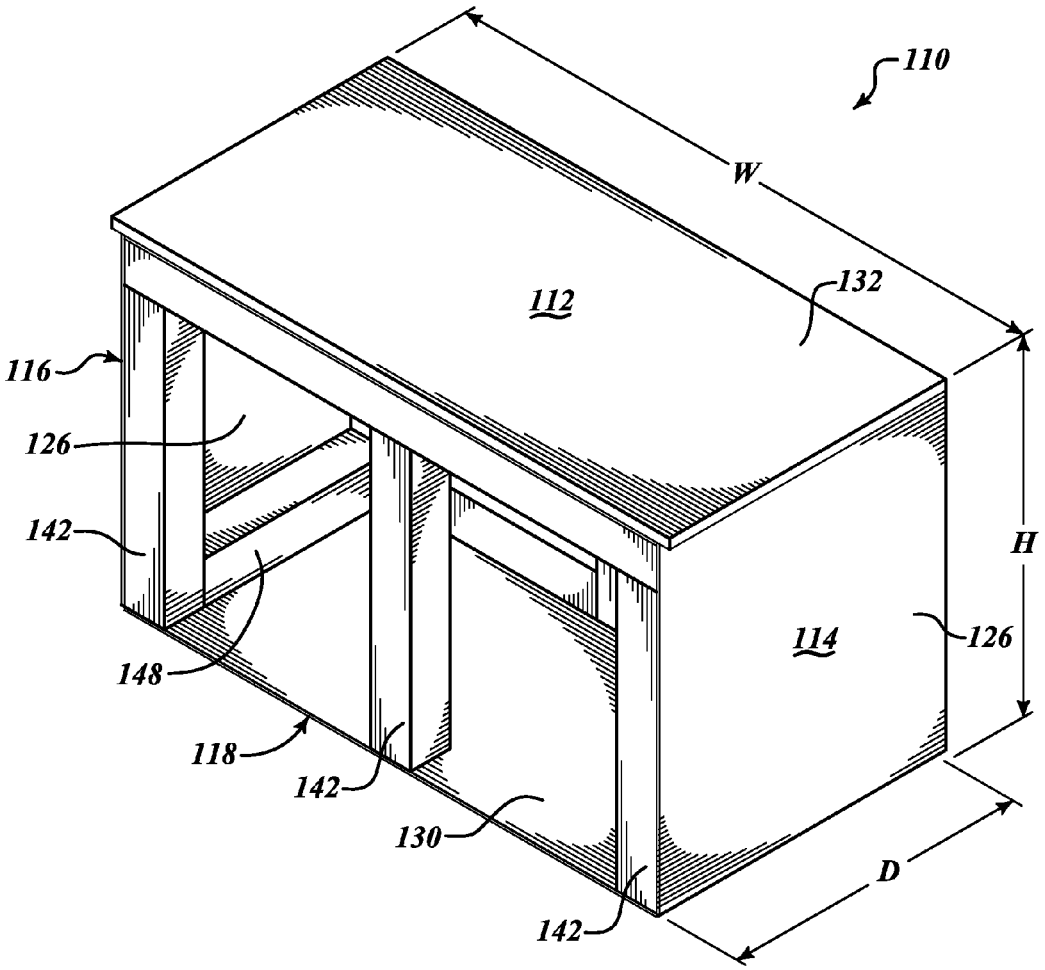
FIG. 5 is a front isometric view of a personal protective structure, according to another embodiment, in the form of another desk.
Figure 6:
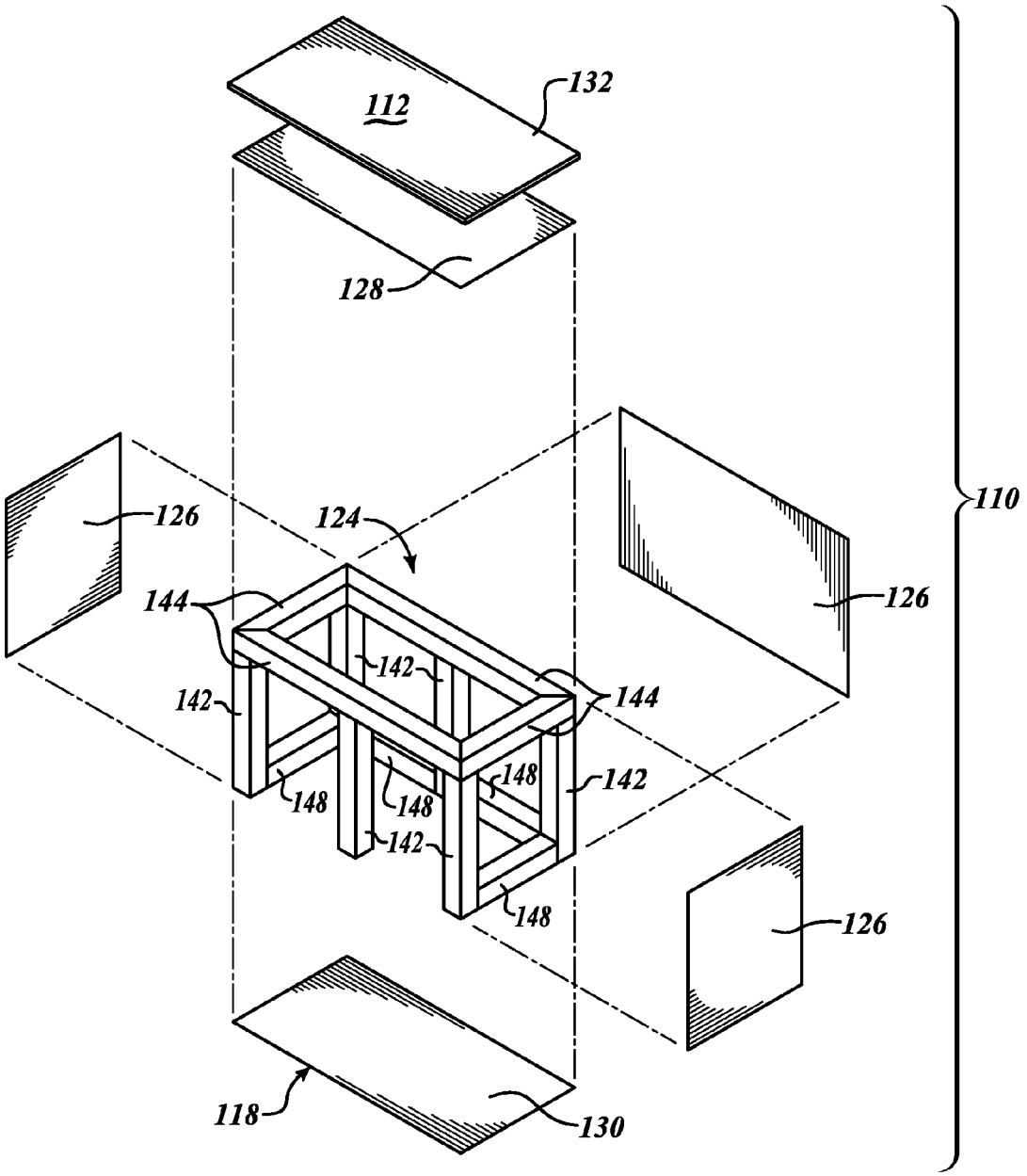
FIG. 6 is a front exploded isometric view of the personal protective structure of FIG. 5.

FIGS. 5 and 6 illustrate a personal protective structure in the form of a school desk 110 according to one embodiment. The desk 110 includes a top working surface 112, opposing side surfaces 114, 116, and a bottom surface 118 for resting on a floor or ground surface. The desk 110 has a support structure which includes a skeletal frame or framework 124 of elongated structural members 142, 144 and a skin of sidewall members 126 coupled thereto, as best shown in FIG. 6. The support structure further includes an upper horizontal sheet or plate 128 and a lower horizontal sheet or plate 130 overlying and underlying the skeletal frame 124, respectively. The components of the support structure (e.g., the skeletal frame 124 and the sidewall members 126) are preferably made of mild or high strength steel and are preferably welded together to form a particularly rigid structure which has a high strength-to-weight ratio.

According to the illustrated embodiment of FIGS. 5 and 6, the support structure may be at least partially covered with an overlay 132, such as, for example, a 1¼" composite sheet material. The overlay 132 may be decorative in nature to provide an aesthetically pleasing piece of furniture by masking at least a portion of the support structure. The overlay 132 may be secured to the support structure via fasteners, adhesives or other devices.

In one embodiment, a desk 110 has a height H of about 28 inches, a width W of about 46 inches, and a depth of about 22 inches. The skeletal frame 124 is formed using 3"×3"×⅛" steel box tubes for the vertical support members 142 and the horizontally aligned elongated structural members 148 at the lower end of the frame 124 and 1"×3"×⅛" steel box tubes for the horizontally aligned elongated structural members 144 at the upper end of the skeletal frame 124. The skeletal frame 124 is then wrapped with sidewall members 126 of ⅛" thick steel plate and topped with an ⅛" steel plate to form the support structure. The desk 110 formed in this manner can be configured to support a static load distributed over an upper surface 112 thereof in excess of 500,000 lbs.

In another embodiment, a desk 110 has a height H of about 28 inches, a width W of about 46 inches, and a depth of about 22 inches. The skeletal frame 124 is formed using 3"×3"×⅛" steel box tubes for the vertical support members 142, 1"×1"×⅛" steel box tubes for the horizontally aligned elongated structural members 148 at the lower end of the frame 124, and 1"×3"×⅛" steel box tubes for the horizontally aligned elongated structural members 144 at the upper end of the frame 124. The skeletal frame 124 is then wrapped with sidewall members 126 of 13 gauge steel sheet on the back and sides and 11 gauge steel sheet on the top and bottom to form the support structure. The desk 110 formed in this manner can be configured to support a static load distributed over an upper surface 112 thereof in excess of 500,000 lbs.

The design and fabrication of personal protective structures described herein having a support structure with a skeletal frame and structural sidewall members wherein the support structure is at least partially covered in one or more overlays can be applied to a variety of structures of varying shapes and sizes and can be combined to meet the needs of an expanded product line, and is not limited to desks structures. For example, similar structures can be used to form, for example, credenzas, conference tables, dining tables, large community tables for classroom settings, beds and various built-in furniture and cabinetry. The personal protective structures can also be provided without any decorative overlays and be configured to fit within a cavity or void of various types of school, office and home furniture or fixtures. For example, office cubicle modules can be placed over or around the personal protective structures described herein such that the protective structures are substantially concealed to maintain a consistent office-like environment while providing enhanced protection during earthquakes and other events.

Figure 7:
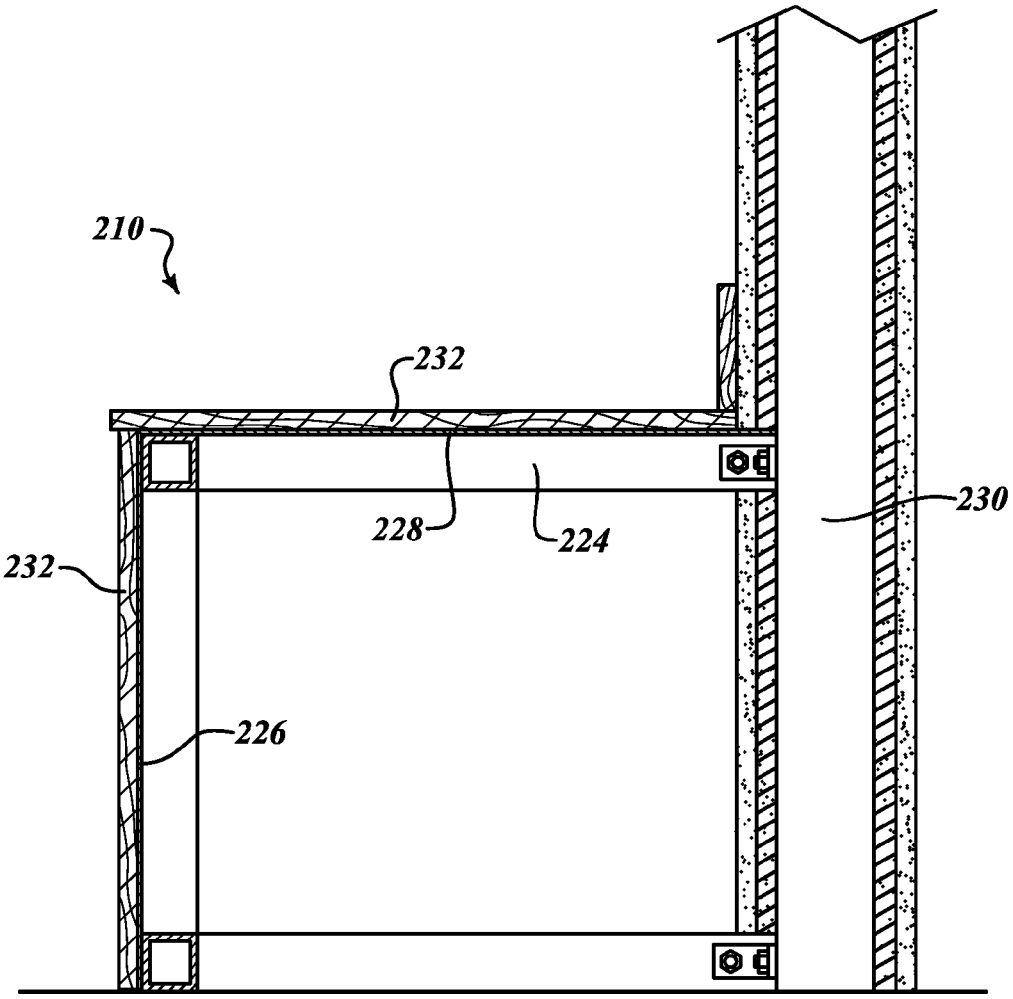
FIG. 7 is a cross-sectional side view of a personal protective structure, according to another embodiment, in the form of a built-in desk.

As a further example of the versatility of the protective structures described herein, FIG. 7 shows a personal protective structure in the form of a built-in desk 210. The built-in desk 210 includes an internal support structure having a skeletal frame 224 of elongated structural members, a sidewall member 226 and an upper sheet or plate 228. The internal support structure is shown coupled to a vertical beam 230 of a wall of a single or multi-story building in which the desk 210 is installed. The built-in desk 210 may be rigidly secured to the beam 230 in any manner, including, for example, bolting the skeletal frame 224 to the beam 230, as shown in FIG. 7. Overlays 232 of various materials may completely or partially cover the external surfaces of the support structure for decorative or functional purposes. The overlays 232 can be, for example, wood, metal, glass, ceramics, composites, plastics or combinations thereof. The overlays 232 may be secured to the support structure 22 via fasteners, adhesives or other devices.

Figure 8:
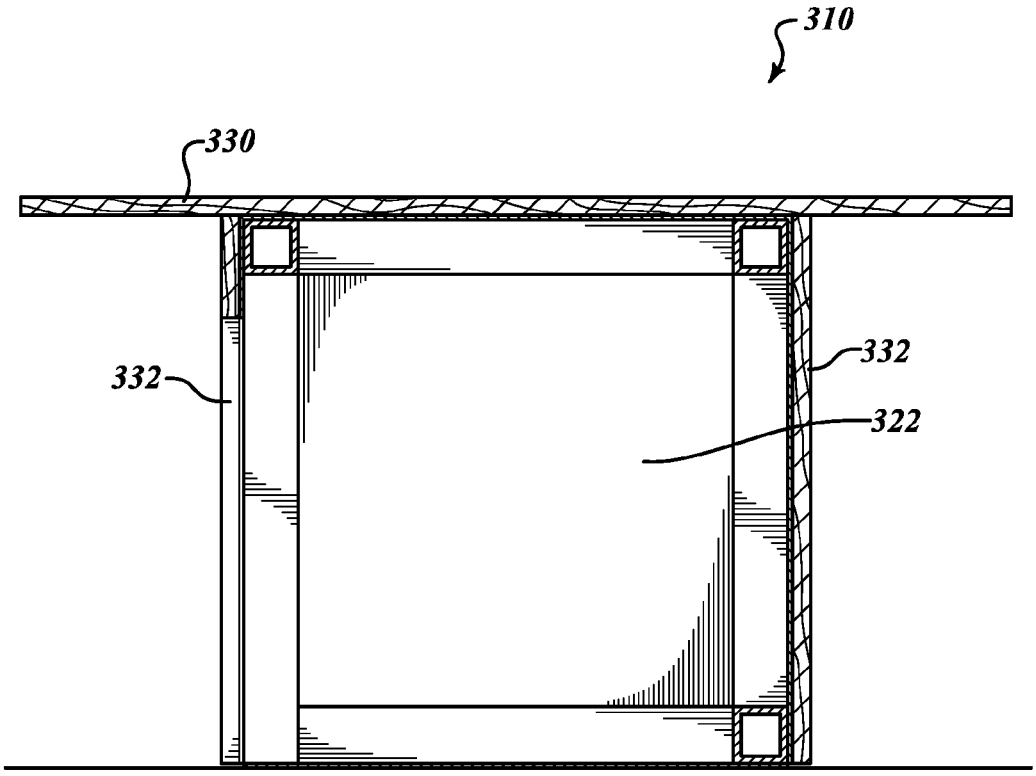
FIG. 8 is a cross-sectional side view of a personal protective structure, according to another embodiment, in the form of a conference table.

FIG. 8 shows a personal protective structure in the form of a conference table 310 for a school, office or home environment. The conference table 310 includes a support structure 322 similar to other embodiments described herein covered with decorative overlays 332 and topped with an overhanging working surface 330.

While aspects of the embodiments described herein are particularly suited for coping with dangers posed by earthquakes, these aspects may be well suited for other applications such as tornado protection, small arms protection and hazardous material and radiation protection. Additional materials such as Kevlar or other composite materials may be incorporated to reduce weight and provide protection from projectiles. The personal protective structures may be lead lined to protect against radiation. Further, the various embodiments described above can be combined to provide further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A personal protective desk to provide protection during earthquakes and other events, the personal protective desk comprising:

a support structure having an internal cavity sized to accommodate one or more persons, the support structure including a skeletal frame of steel including a plurality of elongated vertical support members and an upper frame assembly designed to provide a crumple zone to absorb kinetic energy through permanent deformation thereof when a substantial impact load is applied to the upper surface of the personal protective desk, the upper frame assembly disposed above and supported at least in part by the plurality of elongated vertical support members and including horizontal elongated structural tubular members that extend a full width of the upper frame assembly, and a plurality of steel sidewall members welded directly to the skeletal frame to form an integral support structure that is configured to withstand a static load of at least 50,000 lbs distributed over an upper surface of the personal protective desk without substantial permanent deformation of the elongated vertical support members of the skeletal frame; and an overlay covering at least a portion of an exterior surface of the support structure to at least partially conceal the support structure and to define a work surface of the personal protective desk, and wherein the personal protective desk includes an opening to accommodate legs of a user when the user sits at the desk to use the work surface and to access the internal cavity of the support structure during said earthquakes and other events.

2. The personal protective desk of claim 1 wherein the horizontal elongated structural tubular members are sized and configured relative to the elongated vertical support members to permanently deform to a collapsed state prior to any substantial permanent deformation of the elongated vertical support members when a substantial impact load is applied to an upper surface of the personal protective desk, and wherein the support structure further includes a lower horizontal steel sheet and an upper horizontal steel sheet welded directly to the skeletal frame to form part of the integral support structure, the upper horizontal steel sheet in direct contact with the upper frame assembly of the skeletal frame and the lower horizontal sheet in direct contact with a lower end face of each of the elongated vertical support members.

3. The personal protective desk of claim 2 wherein the upper horizontal steel sheet is a steel plate having a thickness of at least one-eighth inch to protect against penetration from falling objects from an overhead direction.

4. The personal protective desk of claim 3 wherein the steel sidewall members are sheet or plate material having a thickness of at least one-sixteenth inch and a strength equal to or greater than a typical strength of A1011 steel.

5. The personal protective desk of claim 3 wherein the support structure further includes cross braces welded directly to the sidewall members and the skeletal frame to form part of the integral support structure.

6. The personal protective desk of claim 1 wherein the skeletal frame includes at least one vertical support member located inwardly of a perimeter of the skeletal frame.

7. The personal protective desk of claim 1 wherein the skeletal frame includes a plurality of horizontal elongated structural members positioned at a lower end of the personal protective desk with each of the plurality of horizontal elongated structural members welded between respective pairs of the vertical support members.

8. The personal protective desk of claim 7 wherein the horizontal elongated structural members are tubular and have a closed cross-sectional profile.

9. The personal protective desk of claim 1 wherein the overlay covers an entirety of the upper surface of the support structure to define the working surface of the personal protective desk.

10. The personal protective desk of claim 1 wherein the overlay comprises wood, metal, glass, ceramics, composites, plastics or combinations thereof.

11. The personal protective desk of claim 1 having a plurality of overlays covering at least a majority of the exterior surface of the support structure such that the support structure is substantially concealed.

12. The personal protective desk of claim 1 wherein the internal cavity of the support structure has a volume equal to or greater than ten cubic feet.

13. The personal protective desk of claim 1 wherein the internal cavity of the support structure has a volume equal to or greater than twenty cubic feet.

14. The personal protective desk of claim 1 wherein the vertical support members have a closed cross-sectional profile.

15. The personal protective desk of claim 1 wherein the vertical support members are made of a mild or high strength structural steel material.

16. The personal protective desk of claim 1 wherein the personal protective desk is configured to support a static load of at least 100,000 lbs distributed over an upper surface of the personal protective desk without substantial permanent deformation of the elongated vertical support members.

17. The personal protective desk of claim 1 wherein the personal protective desk is configured to a support static load of at least 250,000 lbs distributed over an upper surface of the personal protective desk without substantial permanent deformation of the elongated vertical support members.

18. The personal protective desk of claim 17 wherein the personal protective desk weighs less than 250 lbs such that a strength-to-weight ratio of the personal protective desk in terms of supportable static load without substantial permanent deformation of the elongated vertical support members is at least 1000.

19. The personal protective desk of claim 1 wherein the personal protective desk is configured to a support static load of at least 500,000 lbs distributed over an upper surface of the personal protective desk without substantial permanent deformation of the elongated vertical support members.

20. The personal protective desk of claim 19 wherein the personal protective desk weighs less than 500 lbs such that a strength-to-weight ratio of the personal protective desk in terms of supportable static load without substantial permanent deformation of the elongated vertical support members is at least 1000.

21. The personal protective desk of claim 1 wherein the personal protective desk is configured to a support static load of at least 750,000 lbs distributed over an upper surface of the personal protective desk without substantial permanent deformation of the elongated vertical support members.

22. The personal protective desk of claim 21 wherein the personal protective dsek weighs less than 750 lbs such that a strength-to-weight ratio of the personal protective desk in terms of supportable static load without substantial permanent deformation of the elongated vertical support members is at least 1000.

23. The personal protective desk of claim 1 wherein the personal protective desk is configured to support a static load of at least 1,000,000 lbs distributed over an upper surface of the personal protective desk without substantial permanent deformation of the elongated vertical support members.

24. The personal protective desk of claim 23 wherein the personal protective desk weighs less than 1000 lbs such that a strength-to-weight ratio of the personal protective desk in terms of supportable static load without substantial permanent deformation of the elongated vertical support members is at least 1000.

25. The personal protective desk of claim 1 wherein the personal protective desk is configured to withstand a drop load of at least 50,000 lbs impacting an upper surface of the personal protective desk in a generally evenly distributed manner from a height of about ten feet without substantial permanent deformation of the elongated vertical support members.

26. The personal protective desk of claim 1 wherein an area of a footprint of the personal protective desk is less than twenty-five square feet.

27. The personal protective desk of claim 1 wherein a height of the personal protective is 42 inches or less.

28. The personal protective desk of claim 1, further comprising:

thermal protective padding disposed on at least a portion of an interior of the personal protective desk.

29. The personal protective desk of claim 1, further comprising:

a door rotatably coupled to the personal protective desk to selectively close off an interior of the personal protective desk from an exterior environment.

30. The personal protective desk of claim 1, further comprising:

at least one drawer removably coupled to the personal protective desk and accessible and removable by a person entirely from within the internal cavity.

31. The personal protective desk of claim 1 wherein the personal protective desk is coupled to a wall of a single or multi-story building.

32. A personal protective desk to provide protection during earthquakes and other events, the personal protective desk comprising:

a support structure having an internal cavity sized to accommodate one or more persons, the support structure including a skeletal frame of elongated structural steel members, including a plurality of elongated vertical support members, and a structural skin of steel which is welded directly to the skeletal frame to surround at least a majority of a perimeter of the skeletal frame and form an integral support structure therewith that is configured to withstand a static load of at least 50,000 lbs distributed over an upper surface of the personal protective desk without substantial permanent deformation of the elongated vertical support members; and an overlay covering at least a portion of an exterior surface of the support structure to at least partially conceal the support structure and to define a work surface of the personal protective desk, and wherein the personal protective desk includes an opening to accommodate legs of a user when the user sits at the desk to use the work surface and to access the internal cavity of the support structure during said earthquakes and other events.

33. The personal protective desk of claim 32 wherein the internal cavity of the support structure has a volume equal to or greater than twenty cubic feet.

34. The personal protective desk of claim 32 wherein the support structure further includes an upper horizontal steel sheet and a lower horizontal steel sheet overlying and underlying the skeletal frame, respectively, and which are welded directly to the skeletal frame to form part of the integral support structure.

35. The personal protective desk of claim 32 wherein the personal protective desk is configured to a support static load of at least 250,000 lbs without substantial permanent deformation of the elongated vertical support members.

36. The personal protective desk of claim 32 wherein the personal protective desk is configured to support a static load of at least 1,000,000 lbs distributed over an upper surface of the personal protective desk without substantial permanent deformation of the elongated vertical support members, and wherein the personal protective desk weighs less than 1000 lbs such that a strength-to-weight ratio of the personal protective desk in terms of supportable static load without substantial permanent deformation of the elongated vertical support members is at least 1000.

37. The personal protective desk of claim 32 wherein the personal protective desk is configured to withstand a drop load of at least 10,000 lbs impacting an upper surface of the personal protective desk in a generally evenly distributed manner from a height of about ten feet without substantial permanent deformation of elongated vertical support members.

38. The personal protective desk of claim 32 wherein the skeletal frame includes an upper frame assembly designed to provide a crumple zone to absorb kinetic energy through permanent deformation thereof when a substantial impact load is applied to an upper surface of the personal protective desk, the upper frame assembly disposed above and supported at least in part by the plurality of elongated vertical support members and including horizontal elongated structural tubular members that extend a full width of the upper frame assembly.

39. The personal protective desk of claim 38 wherein the horizontal elongated structural tubular members are sized and configured relative to the elongated vertical support members to permanently deform to a collapsed state prior to any substantial permanent deformation of the elongated vertical support members when a substantial impact load is applied to an upper surface of the personal protective desk.

40. The personal protective desk of claim 32 wherein the elongated structural steel members of the skeletal frame further comprise a plurality of horizontal elongated structural members, the horizontal elongated structural members positioned at a lower end of the personal protective desk with each of the plurality of horizontal elongated structural members welded between respective pairs of the elongated vertical support members.

* * * * *

UNITED STATES PATENT AND TRADEMARK OFFICE

CERTIFICATE OF CORRECTION

PATENT NO. : 9,121,188 B2
APPLICATION NO. : 13/106597
DATED : September 1, 2015
INVENTOR(S) : Robert Franklin von Bereghy It is certified that error appears in the above-identified patent and that said Letters Patent is hereby corrected as shown below:

IN THE CLAIMS

Column 11, Line 66:
"personal protective dsek weighs less than 750 lbs such that a" should read, --personal protective desk weighs less than 750 lbs such that a--.

Signed and Sealed this
Sixteenth Day of February, 2016

Michelle K. Lee

Michelle K. Lee
*Director of the United States Patent and Trademark Office*